US009022719B2

(12) United States Patent
Yoshikane et al.

(10) Patent No.: US 9,022,719 B2
(45) Date of Patent: May 5, 2015

(54) CONVEYER MAGAZINE-TYPE EMPTY BAG SUPPLYING APPARATUS

(71) Applicant: Toyo Jidoki Co., Ltd., Minato-ku, Tokyo (JP)

(72) Inventors: Tohru Yoshikane, Iwakuni (JP); Masahiko Murashige, Iwakuni (JP)

(73) Assignee: Toyo Jidoki Co., Ltd., Tokyo (JP)

( * ) Notice: Subject to any disclaimer, the term of this patent is extended or adjusted under 35 U.S.C. 154(b) by 143 days.

(21) Appl. No.: 13/921,010

(22) Filed: Jun. 18, 2013

(65) Prior Publication Data

US 2013/0343857 A1 Dec. 26, 2013

(30) Foreign Application Priority Data

Jun. 20, 2012 (JP) ..... 2012-138361

(51) Int. Cl.

| | |
|---|---|
| ***B65B 43/14*** | (2006.01) |
| ***B65H 3/08*** | (2006.01) |
| ***B65H 1/22*** | (2006.01) |
| ***B65B 43/18*** | (2006.01) |
| ***B65H 3/00*** | (2006.01) |
| ***B65H 5/06*** | (2006.01) |
| ***B65H 1/02*** | (2006.01) |

(Continued)

(52) U.S. Cl.

CPC ..... *B65B 43/14* (2013.01); *B65B 43/18* (2013.01); *B65H 3/00* (2013.01); *B65H 5/06* (2013.01); *B65H 1/025* (2013.01); *B65H 3/08* (2013.01); *B65H 5/025* (2013.01); *B65H 9/004* (2013.01); *B65H 2701/191* (2013.01)

(58) Field of Classification Search

CPC ..... B65B 43/14; B65B 43/18; B65H 1/22; B65H 3/04; B65H 3/00; B65H 5/06; B65H 5/10

USPC ..... 271/104, 105, 107, 150, 151, 158, 161, 271/19, 20–22, 264, 268, 31, 902; 414/796.4, 796.5, 796.9, 797, 797.3, 414/797.4, 797.6, 797.7, 797.8; 53/386.1

See application file for complete search history.

(56) References Cited

U.S. PATENT DOCUMENTS

| | | | | | |
|---|---|---|---|---|---|
| 1,112,609 | A | * | 10/1914 | Harris | 271/22 |
| 1,250,990 | A | * | 12/1917 | Dexter et al. | 271/20 |
| 3,583,695 | A | * | 6/1971 | Sherwood | 271/21 |

(Continued)

FOREIGN PATENT DOCUMENTS

| | | | |
|---|---|---|---|
| EP | 2 149 499 | A | 2/2010 |
| JP | 2003-137219 | A | 5/2003 |

(Continued)

*Primary Examiner* — Gregory Adams

(74) *Attorney, Agent, or Firm* — DLA Piper LLP (US)

(57) ABSTRACT

A conveyer magazine-type empty bag supplying apparatus including an empty bag separator for separating the topmost empty bag from a set of empty bags and feeding it forward, a positioning stopper for the front end of the fed-out empty bag coming into touch therewith, ratchet wheels coming into contact with the empty bag fed by the empty bag separator and feeding the bag forward, causing the bag to come into touch with the positioning stopper, and an empty bag suction members for adhering to and picking up the bag positioned by the positioning stopper. The ratchet wheels are provided on pivoting arms so as to be oscillatingly moved between its delivery position and its retracted position. The delivery position is between the positioning stopper and the empty bag suction members and the retracted position is on the front side which is beyond the stop surface of the positioning stopper.

5 Claims, 4 Drawing Sheets

(51) Int. Cl.
*B65H 5/02* (2006.01)
*B65H 9/00* (2006.01)

(56) References Cited

U.S. PATENT DOCUMENTS 3,861,668 A * 1/1975 Wood ..... 271/15
4,545,184 A * 10/1985 Akiyama ..... 53/571
4,585,226 A * 4/1986 LaBate ..... 271/264
4,802,662 A * 2/1989 Hobbelt et al. ..... 271/20
4,823,538 A * 4/1989 Takamura ..... 53/512
5,356,129 A * 10/1994 Godlewski ..... 271/212
6,715,750 B1 * 4/2004 Gerlier et al. ..... 271/21
7,654,516 B2 * 2/2010 Terao et al. ..... 271/119
2005/0067754 A1 * 3/2005 Shigenaga et al. ..... 271/30.1
2010/0024362 A1 * 2/2010 Inoue et al. ..... 53/459

FOREIGN PATENT DOCUMENTS

JP 3639199 4/2005
WO WO 92/20581 11/1992

* cited by examiner

CONVEYER MAGAZINE-TYPE EMPTY BAG SUPPLYING APPARATUS

BACKGROUND OF THE INVENTION

1. Field of the Invention

The present invention relates to an improvement in a conveyer magazine-type empty bag supplying apparatus used to supply empty bags to a bag filling packaging machine.

2. Description of the Related Art

Japanese Patent Application Laid-Open (Kokai) No. 2003-137219 discloses a conveyer magazine-type empty bag supplying apparatus used to supply empty bags to an intermittently rotating rotary-type bag filling packaging machine. This conveyer magazine-type empty bag supplying apparatus includes: a belt conveyer for conveying a set of empty bags stacked with a displacement in the fore-and-aft direction of (or in a direction parallel to) the conveying direction of the belt conveyor such that the mouths of the bags face forward and upper empty bags are shifted forward, a fast-feed belt (an empty bag separating means) provided above the belt conveyer, ratchet wheels provided on a forward side of the fast-feed belt, a positioning stopper provided near the forward end of the belt conveyer, and empty bag suction members provided between the ratchet wheels and the positioning stopper.

In the above structure, the fast-feed belt separates the topmost empty bag from the set of the empty bags on the belt conveyer and feeds it forward. The ratchet wheels, which have a plurality of flexible radially-extending pawl elements (projections) arranged around them, are connected to a drive source and rotate, while moving up and down between its lower delivery position and its upper retracted position, such that, in the delivery position, they come in contact with the empty bag fed by the fast-feed belt and feed it farther forward, causing the bag to come into touch with the positioning stopper. The positioning stopper, which is provided near the forward end of the belt conveyer, is used for positioning the empty bags supplied by the ratchet wheels. The empty bag suction members are moved up and down between its lower suction position, in which they adhere to the upper surface of an empty bag positioned by the positioning stopper, and its upper pickup position.

In addition, a chuck used for transporting empty bags is provided between the conveyer magazine-type empty bag supplying apparatus and the intermittently rotating rotary-type bag filling packaging machine. When the empty bag suction members arrive at the pickup position, the upper edge portion of the adhered empty bag is gripped by this chuck, and the empty bag is subsequently transported by the chuck and transferred to the grippers of the intermittently rotating rotary-type bag filling packaging machine.

Japanese Patent No. 3,639,199 discloses another type of conveyer magazine-type empty bag supplying apparatus used to supply empty bags to a bag filling packaging machine. The basic construction of this conveyer magazine-type empty bag supplying apparatus is substantially the same as that of Japanese Patent Application Laid-Open (Kokai) No. 2003-137219 in which an empty bag fed forward by the fast-feed belt is fed farther forward and caused to come into touch with the positioning stopper by ratchet wheels provided behind the empty bag suction members; however, in the apparatus of Japanese Patent No. 3,639,199, rotating rollers are provided, instead of ratchet wheels, so that the rotating rollers are moved up and down in an oscillating manner and in equilibrium with a balancer in a position that is substantially aligned with the empty bag suction members.

The conveyer magazine-type empty bag supplying apparatus described in Japanese Patent Application Laid-Open (Kokai) No. 2003-137219 has several problems as noted below:

(1) Since the ratchet wheels are provided between the fast-feed belt and the empty bag suction members, the gap between the ratchet wheels and the positioning stopper is relatively wide. For this reason, an empty bag fed by the ratchet wheels is, after having come into touch with the positioning stopper, warped upward or undergoes convex deformation, resulting in such problems as positioning errors of the empty bag and pickup errors that would occur when the empty bag suction members pickup the empty bag. This will be described below with reference to FIGS. 4A and 4B. In FIGS. 4A and 4B, the reference numeral 1 designates an empty bag, 2 a ratchet wheel, 3 a belt conveyer, 4 a positioning stopper, 5 a position-detecting sensor, 6 an empty bag suction member, 7 a belt conveyer frame, and 8 a lateral guide for the belt conveyer.

(1) When an empty bag 1 is fed forward by the fast-feed belt (not shown), the ratchet wheels 2, which rotate in the direction of the curved arrow, descend from the retracted position indicated by the two-dot chain line to the delivery position indicated by the solid line and come in contact with the upper surface of the empty bag 1 on the belt conveyer 3, and then the empty bag 1 is fed further forward on the belt conveyer 3 by the ratchet wheels 2, and its front end (mouth edge) comes into touch with the positioning stopper 4, and then the bag is properly positioned by the positioning stopper 4. The position-detecting sensor 5 detects the bag 1 thus positioned. After detection by the position-detecting sensor 5, the ratchet wheels 2 stay in the delivery position for some time in order to permit reliable determination of the position of the bag 1 and continue feeding of the bag 1. Subsequently, the ratchet wheels are raised to the retracted position. At that time, as a result of overfeeding by the ratchet wheels 2, the front part of the empty bag may bend upward (as shown in FIG. 4A) or undergo convex deformation (as shown in FIG. 4 B), which leads to positioning errors and pickup errors when the empty bag suction members 6 pick up the bag. This problem is especially pronounced when the empty bag 1 is relatively soft.

(2) In the conveyer magazine-type empty bag supplying apparatus, the delivery position of the ratchet wheels 2 is mechanically set in advance. For this reason, if the supplied empty bag 1 is one made of relatively thick material, or if there is a pile of a plurality of empty bags 1 fed by the fast-feed belt, the force of contact of the ratchet wheels 2 applied on the empty bag 1 (the degree of bending of the flexible pawls) increases, which leads to overfeeding and causes the above-described problem (1) to occur in a pronounced manner.

(3) If the location of the positioning stopper 4 is made freely adjustable in the fore-and-aft direction, then changing its location makes it possible to adjust the gap between the front end of the empty bag 1 and the suction position of the empty bag suction members 6 and to change the vertical position of the empty bag 1 supplied to the grippers of the packaging machine (and thus change the sealing position and the vertical width of the seal). In this configuration, when the position of the positioning stopper 4 is moved forward, the gap between the positioning stopper 4 and the ratchet wheels 2 is widened, and this causes the above-described problem (1) to occur in a pronounced manner as well.

(4) The timing of the descend of the ratchet wheels 2 to the delivery position is set to occur after the fast-feed belt separates the topmost empty bag 1 from the set of empty bags on the belt conveyer 3 and feeds it forward, and when the ratchet wheels 2 descend to the delivery position, the ratchet wheels 2 come into contact with the upper surface of the supplied empty bag 1. For this reason, if the front portion of the empty bag 1 is already warped, its warp cannot be rectified, and it is difficult to properly position the empty bag 1.

(5) On the other hand, it is believed that in the conveyer magazine-type empty bag supplying apparatus described in Japanese Patent No. 3,639,199, the above-described problems (1)-(4) are less likely to occur than in the apparatus of Japanese Patent Application Laid-Open (Kokai) No. 2003-137219 because the rotating rollers, which are believed to correspond to the ratchet wheels 2 of Japanese Patent Application Laid-Open (Kokai) No. 2003-137219, are disposed in positions where they are substantially aligned with the empty bag suction members; and as a result, the gap between the rotating rollers and the positioning stopper is reduced and, in addition, the rotating rollers are almost always in the lower position in equilibrium with a balancer and the empty bags fed by the fast-feed belt are pressed down by the rotating rollers. Since, however, the rotating rollers are in contact with the surface of the empty bag while in equilibrium with the balancer and are constantly pushing the empty bag against the positioning stopper, it is undeniable that the warping and convex deformation described in (1) above would occur in the empty bag at that time.

In addition, in this conveyer magazine-type empty bag supplying apparatus of Japanese Patent No. 3,639,199, when the empty bag suction members holding an empty bag are raised, there is a risk that the empty bag may come in contact with the rotating rollers and lift the rollers up; and when this happens the empty bag is separated from the empty bag suction members or is caused to position changes. Due to the positional relationship between the rotating rollers and the empty bag suction members, it is believed that as long as the rotating rollers do not deviate from the trajectory of an empty bag, an empty bag cannot be brought to the pickup position above the belt conveyer. However, there are questions about whether it is actually possible for an empty bag held by the empty bag suction members to lift the rotating rollers up. Even if it is possible and lifting of rotating rollers occurs whenever one empty bag is supplied, production efficiency (supply rate) would be extremely low and unstable.

BRIEF SUMMARY OF THE INVENTION

The present invention was devised by taking the above-described problems of the conventional conveyer magazine-type empty bag supplying apparatus into consideration, and it is an object of the present invention to provide a conveyer magazine-type empty bag supplying apparatus in which empty bag positioning errors and pickup errors are prevented from occurring while at the same time supply of empty bags is executed at the same level of production efficiency as that in the prior art.

The above object is accomplished by a unique structure of the present invention for a conveyer magazine-type empty bag supplying apparatus that comprises:

a belt conveyer for feeding a set of empty bags stacked with a displacement in the fore-and-aft direction of (or in a direction parallel to) the conveying direction of the conveyer such that the mouths of the bags face forward in the conveying direction and upper empty bags are shifted forward in the conveying direction;

an empty bag separating means provided above the belt conveyer for separating the topmost empty bag from the set of empty bags and feeding the separated empty bag forward;

a positioning stopper having a stop surface and provided near the forward end of the belt conveyer so that the front end of the separated empty bag on the belt conveyer comes into touch with the stop surface;

a ratchet wheel(s) provided on the forward side of the empty bag separating means and has a plurality of flexible radially-extending pawl element(s) therearound, the ratchet wheel(s) being connected to a drive source, rotated while being moved between a delivery position and a retracted position, thus in the delivery position coming into contact with the empty bag that is fed by the empty bag separating means, feeding the empty bag forward, and causing the empty bag to come into touch with the stop surface of positioning stopper; and an empty bag suction member(s) movable up and down between a suction position and a pickup position located a higher position than the suction position, the empty bag suction member(s) adhering to the upper surface of the empty bag positioned by the positioning stopper, and in the present invention, the delivery position of the ratchet wheel(s) is between the positioning stopper and the empty bag suction member, and the retracted position of the ratchet wheel is on a front side which is beyond the stop surface of the positioning stopper.

In the above-described conveyer magazine-type empty bag supplying apparatus of the present invention:

(1) The timing of ratchet wheel movement to the delivery position is set to occur prior to the moment when the front end of an empty bag fed by the empty bag separating means reaches the delivery position of the ratchet wheel(s).

(2) A regulation ring(s) having a circumferential surface(s) with a diameter that is smaller than the diameter of the rotational trajectory of the distal end(s) of the pawl element(s) is rotatably installed on the rotary shaft for the ratchet wheel(s).

(3) A sub-frame is provided at the forward end of the belt conveyer so as to be positionally adjustable to come closer to and separated from each other, and the positioning stopper and ratchet wheel(s) are provided in the sub-frame.

As seen from the above, in the conveyer magazine-type empty bag supplying apparatus according to the present invention, the gap between the ratchet wheel(s) and the positioning stopper can be reduced. Accordingly, it is possible to prevent the front part of an empty bag from warping upward or undergoing convex deformation when fed by the ratchet wheel(s), and as a result, positioning errors of the empty bag and pickup errors that would occur when the empty bag suction member(s) pickup the empty bag can be prevented even when bags supplied are of low-rigidity (soft) or thick.

In addition, in the conveyer magazine-type empty bag supplying apparatus according to the present invention, the timing of ratchet wheel movement to the delivery position can be set to occur prior to the moment when the front end of an empty bag supplied by the empty bag separating means reaches the delivery position of the ratchet wheel(s). Accordingly, the front end of the empty bag fed by the empty bag separating means goes under and is pressed down by the ratchet wheel(s) rotating in the delivery position. Accordingly, even when the front portion of the empty bag is warped originally, the ratchet wheel(s) can apply pressure to the front portion of the bag and correct the warpage, so that the empty bag can be fed forward to the positioning stopper in a flattened state, thus assuring stable positioning of the empty bag.

In the conveyer magazine-type empty bag supplying apparatus of the present invention, a regulation ring(s) can be installed on the rotary shaft for the ratchet wheel(s). When the regulation ring(s) is thus installed, the delivery position (lowered end position) of the ratchet wheel(s) is regulated by the regulation ring(s), and application of excessive contact force by the ratchet wheel(s) to the empty bag (the extent of bending of the flexible pawl(s)) can be prevented even if the empty bag is relatively thick or even if there is a pile of a plurality of empty bags fed by the empty bag separating means. Accordingly, overfeeding of the empty bags by the ratchet wheels can be prevented, and upward warping of the front portion of the empty bags or their convex deformation can be prevented; and, as a result, positioning errors of the empty bag and pickup errors that would occur when the empty bag suction member(s) pickup the empty bag can be both prevented.

In the conveyer magazine-type empty bag supplying apparatus according to the present invention, a sub-frame is provided at the forward end of the belt conveyer so that it is in a positionally adjustable manner in the fore-and-aft direction or in parallel to the conveying direction of the conveyor, and the positioning stopper and ratchet wheel(s) are provided in the sub-frame. In this structure, the relative positional relationship between the ratchet wheel(s) and the positioning stopper does not change even when the position of the positioning stopper is changed (when the vertical position of the empty bag supplied to the grippers of the packaging machine is changed) by adjusting the position of the sub-frame. Accordingly, upward warping or convex deformation of the front portion of the empty bag can be prevented, thus making it possible to prevent positioning errors of the empty bag and pickup errors that would occur when the empty bag suction member(s) pickup the empty bag.

DETAILED DESCRIPTION OF THE INVENTION

Figure 3:
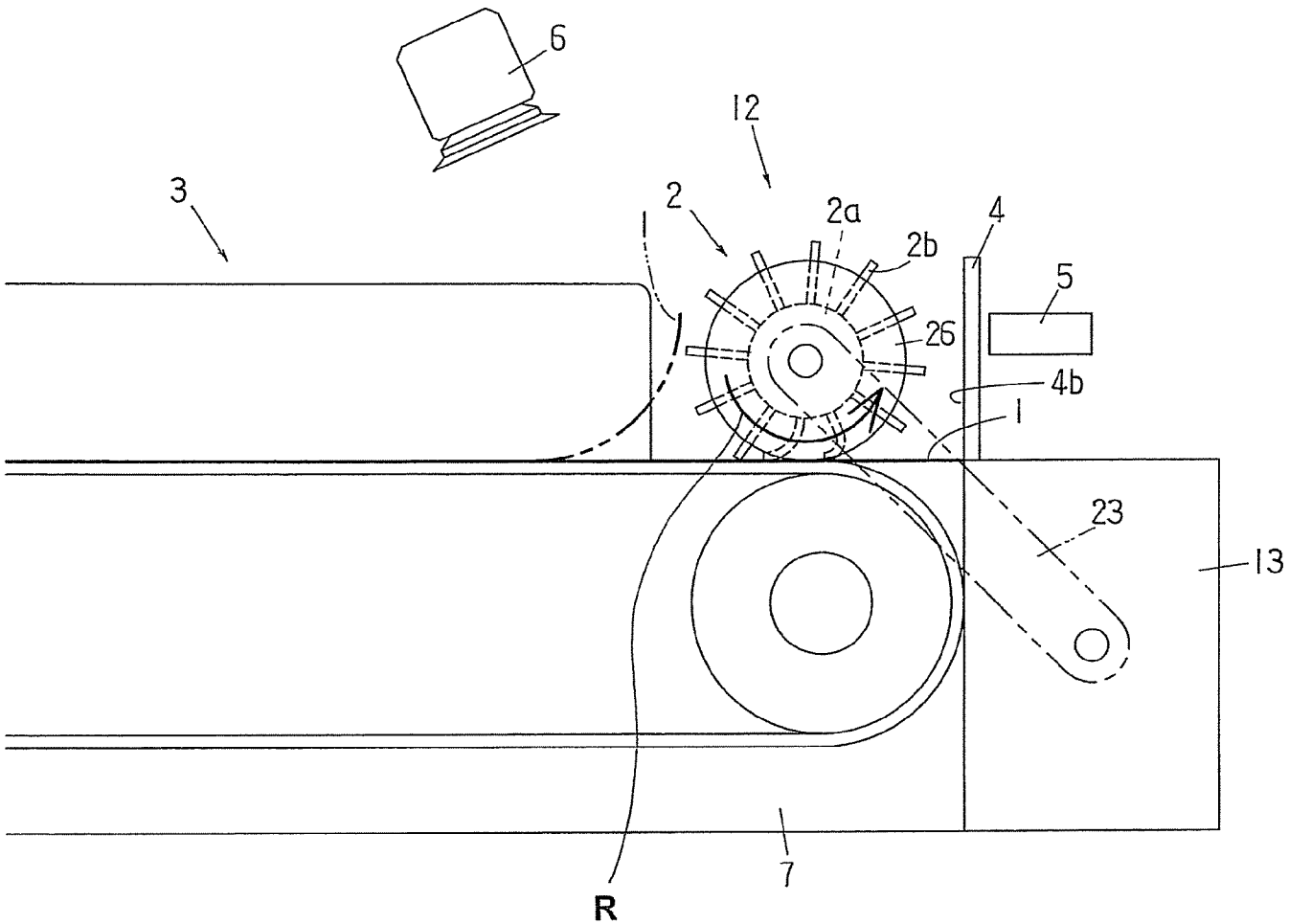
FIG. 3 is an enlarged side view of the ratchet unit, illustrating the action of the ratchet wheel(s) of the conveyer magazine-type empty bag supplying apparatus of the present invention.
Figure 4B:
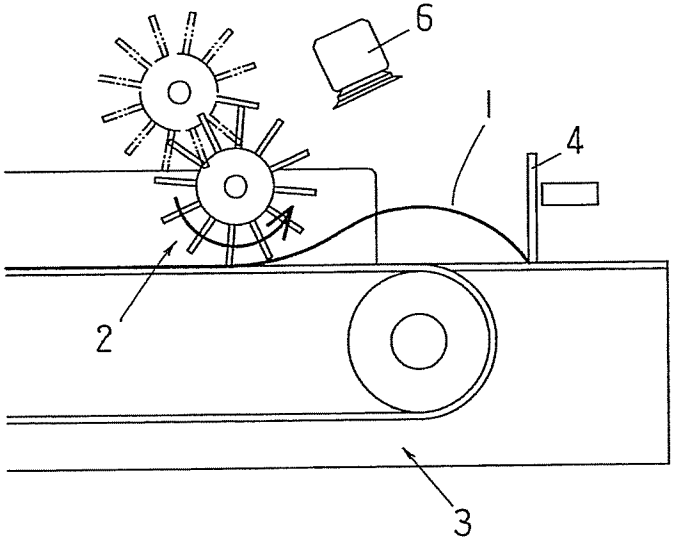
FIG. 4B RELATED ART
FIGS. 4A and 4B are diagrams illustrating problems associated with ratchet wheels in a conventional conveyer magazine-type empty bag supplying apparatus.
Figure 4A:
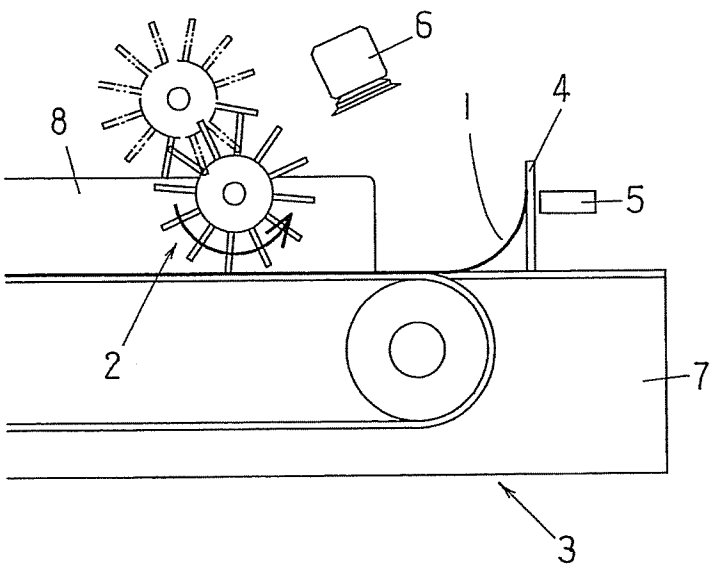
FIG. 4A RELATED ART

The conveyer magazine-type empty bag supplying apparatus according to the present invention will be described below with reference to FIGS. 1 to 3. The reference numerals assigned to various parts and locations in FIGS. 1 to 3 are the same as those in FIGS. 4A and 4B.

Figure 1:
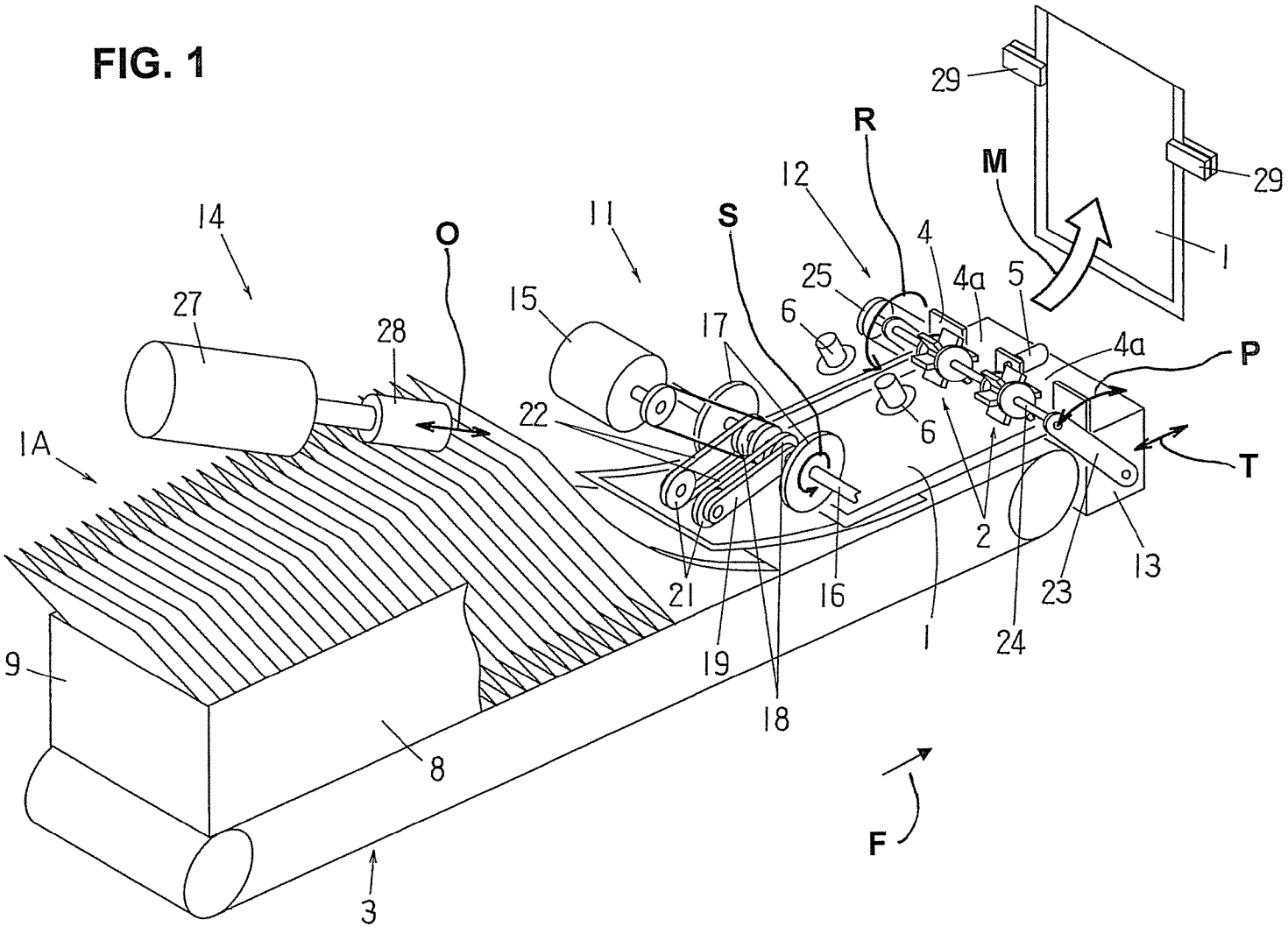
FIG. 1 is a perspective view of a conveyer magazine-type empty bag supplying apparatus according to the present invention.
Figure 2:
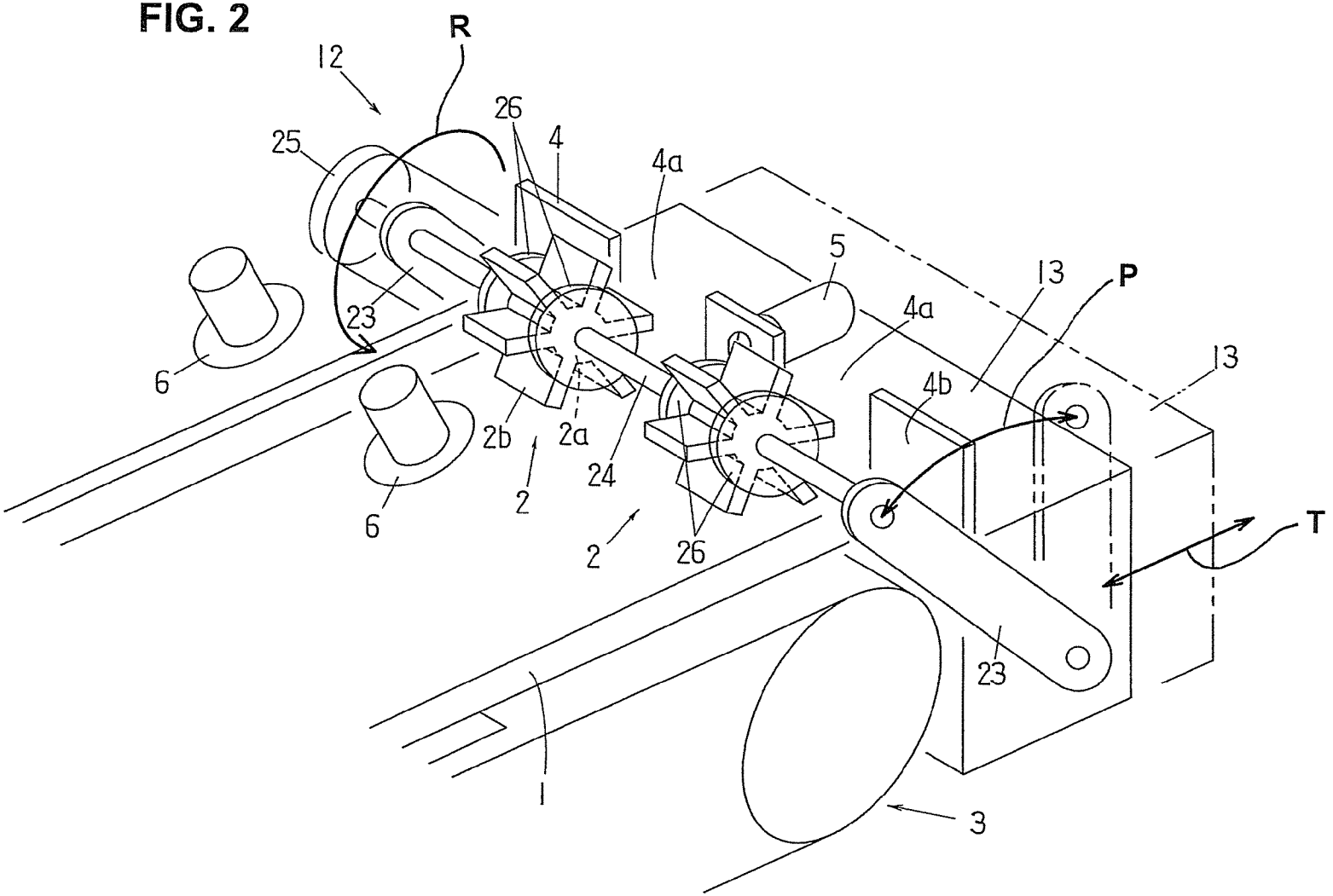
FIG. 2 is an enlarged perspective view of the ratchet unit thereof.

The conveyer magazine-type empty bag supplying apparatus illustrated in FIGS. 1 and 2 includes, among others, a belt conveyer 3 that conveys empty bags 1, lateral guides 8 for guiding the empty bags 1, a rear guide 9 integrated with the lateral guides 8, an empty bag separating means 11, an ratchet device 12, a positioning stopper 4, a position-detecting sensor 5, an empty bag pickup means (only a pair of empty bag suction members 6 are shown), a sub-frame 13, and an empty bag unstacking means 14.

The empty bag separating means 11 comprises, among others, a drive motor 15, a rotating shaft 16, a pair of forward-feed rollers 17 secured to the rotating shaft 16 and rotated thereby in the direction of arrow S, a pair of drive pulleys 18, a pair of freely-pivoting arms 19 rotatably attached to the rotating shaft 16, a pair of driven pulleys 21 rotatably attached to the (rear) distal end of the freely-pivoting arms 19, and a pair of fast-feed belts 22 provided between the drive pulleys 18 and the driven pulleys 21. The rotating shaft 16 is rotatably supported at both its ends by the frame (not shown) of the belt conveyer 3, and it is rotated by the drive motor 15. The topmost empty bag in the set of empty bags 1A is separated from the set of empty bags 1A and fed forward which is indicated by arrow F by the fast-feed belt 22, and then the empty bag is further fed forward by the forward-feed rollers 17 operating at a high circumferential speed.

The sub-frame 13 is provided at the forward end of the frame (not shown) of the belt conveyer 3 so that the sub-frame 13 can be, for its position, adjusted in the fore-and-aft direction or in a direction parallel to the conveying (forward) direction F of the belt conveyor 3 (see two-head arrow T), so that the sub-frame 13 can come closer to and separated from the belt conveyor 3. Thus, the sub-frame 13, when needed, is moved so that as shown in FIG. 2 its position can be changed, for instance, from the solid-line position to the two-dot chain line position. The ratchet device 12, the positioning stopper 4, and the position-detecting sensor 5 are all provided on the sub-frame 13.

The positioning stopper 4 is formed with two cutout sections 4*a* and is disposed on the rear end of the sub-frame 13. The rear surface of the positioning stopper 4 makes a stop surface 4*b*.

As shown in the FIG. 2, the ratchet device 12 includes a pair of pivoting arms 23 that have their proximal ends journaled to the sub-frame 13 for making a swing motion in the fore-and-aft direction (see the double-headed arc arrow P) between the position indicated by the solid line and the position indicated by the two-dot chain line. The ratchet device 12 further includes a rotary shaft 24 rotatably supported by the pivoting arms 23, a pair of ratchet wheels 2, and a drive pulley 25 secured to one end of the rotary shaft 24. The sub-frame 13 contains an air cylinder (not shown) which is used as a drive source for the swing motion of the pivoting arms 23, and a motor (not shown) which is used as a drive source for rotating the rotary shaft 24 via the drive pulley 25 is also provided in the sub-frame 13.

Each of the ratchet wheels 2 has a plurality of flexible radially-extending pawl elements (projections) 2*b* arranged around the shaft portion 2*a*. In addition, a pair of regulation rings 26 are installed on the rotary shaft 24 so as to be in contact with both sides of each one of the pawl elements 2*b*. Each of the regulation rings 26 has a circumferential surface with a diameter smaller than the diameter of the rotational trajectory (circumference) of the distal ends of the pawl elements 2*b* of the ratchet wheel 2. The regulation rings 26 are fitted on the rotary shaft 24 in a rotatable manner (such that free rotation is permitted) while precluding movement in the axial direction of the rotary shaft 24. When the pivoting arms 23 swing between the solid-line position and the two-dot chain line position in FIG. 2 as indicated by arrow P, the ratchet wheels 2 are moved from one side (upper stream side in terms of the conveying direction F) of the positioning stopper 4 to another side (down stream side) of the positioning stopper 4 and vice versa. In other words, the ratchet wheels 2 are movable between the delivery position (a position on the upper stream side of the positioning stopper 4 illustrated in FIGS. 1 and 2 in solid lines) and the retracted position (a position on the down stream side of the positioning stopper 4 or on the front or forward side which is beyond the stop surface 4*b* of the positioning stopper 4) that is illustrated in FIG. 2 by two-dot chain line of the pivoting arms 23 on which the ratchet wheels 2 are provided via the rotary shaft 24. As seen from FIGS. 1 and 2, the delivery position of the ratchet wheels 2 is set between the positioning stopper 4 and the empty bag suction members 6, and the retracted position of the ratchet wheels 2 is set on the down stream side of the positioning stopper 4 or on the front or forward side of the positioning stopper 4 which is beyond the stop surface 4*b* of the positioning stopper 4.

When the pivoting arms 23 arrive at the two-dot chain line position in FIG. 2, the ratchet wheels 2 are at the retracted position. When the ratchet wheels 2 are moved between the delivery position and the retracted position, they pass through the cutout sections 4*a* of the stopper 4.

The empty bag unstacking means 14 comprises an air cylinder 27, which is used as a drive source, and an unstacking member 28 secured to the distal end of the piston rod of the air cylinder 27. The unstacking member 28 oscillates back and forth by the air cylinder 27 as indicated by arrow O.

The pair of empty bag suction members 6 of the empty bag pickup means are provided so as to be moved up and down between its suction position and its pickup position (position illustrated in FIGS. 1 and 2). At the suction position, the empty bag suction members 6 adhere to the upper surface of an empty bag 1 positioned by the stopper 4. The pickup position of the empty bag suction members 6 is set higher in elevation than the suction position.

In FIG. 1, the reference numerals 29 refer to grippers of a packaging machine (not shown). In the same manner as in the conventional apparatuses, the empty bag 1, which is held and picked up by the empty bag suction members 6, is transferred from the empty bag suction members 6 to the grippers 29 as indicated by curved arrow M using a chuck unit, not shown.

The above-described conveyer magazine-type empty bag supplying apparatus operates as described below.

A set of empty bags 1A is stacked on the belt conveyer 3 with a displacement in the fore-and-aft direction in term of the conveying direction of the belt conveyor 3 such that the mouths of the bags face forward (see arrow F) and upper empty bags are shifted forward (in term of forward direction of the belt conveyor 3) in the stack. The bags are guided at the lateral edges by the lateral guides 8 of the belt conveyor 3 and conveyed forward as shown by arrow F. Before the empty bag separating means 11, the layered set of empty bags 1A is subjected to oscillatory vibration by the empty bag unstacking means 14; as a result, the stack of bags is loosened up and subsequently forwarded to the empty bag separating means 11. An empty bag 1 (that was the top-most bag in the stack) fed to the empty bag separating means 11 comes into contact with the fast-feed belts 22 and then the forward-feed rollers 17, and as a result of which the bag 1 is separated from the set of empty bags 1A and successively fed forward.

Before the distal (front or forward) end of the empty bag 1 fed by the empty bag separating means 11 arrives at the delivery position of the ratchet wheels 2 on the belt conveyer 3, the pivoting arms 23 swing and the rotating ratchet wheels 2 are moved from the retracted position to the delivery position. As a result, the empty bag 1 that arrives at the delivery position is pressed down by the ratchet wheels 2 and fed farther forward, and its distal (front or forward) end comes into contact with the positioning stopper 4, so that the positioning of the bag 1 is made by the positioning stopper 4. The position of the bag 1 is detected by a position-detecting sensor 5.

After the detection of the position of the bag 1 by the position-detecting sensor 5, the ratchet wheels 2 stay in the delivery position for a predetermined brief period of time, and then the pivoting arms 23 swing back, and the ratchet wheels 2 are moved to the retracted position.

Next, the empty bag suction members 6 are lowered to the suction position and adhere to the top surface of the bag 1. Subsequently, the empty bag suction members 6 are raised to the pickup position, so that the empty bag 1 adhered thereto is raised from the belt conveyer 3. Since at this point the ratchet wheels 2 have moved to the retracted position (on the front (or forward or down stream) side and beyond the stop surface 4*a* of the positioning stopper 4), the ratchet wheels 2 do not interfere with the rising empty bag suction members 6 and empty bag 1. The empty bag 1 is then gripped by the chuck of a chuck device (not shown) and transferred to the grippers 29 of the packaging machine.

In the above-described structure, by adjusting (changing) the position of the sub-frame 13 in the fore-and-aft direction as indicated by arrow T, it is possible to adjust (change) the distance between the positioning stopper 4 and the empty bag suction members 6, and changing this distance makes it possible to change the vertical position of the empty bag 1 supplied to the grippers 29 of the packaging machine. On the other hand, since the relative position of the positioning stopper 4 and the ratchet wheels 2 stays constant (because they are both provided on the sub-frame 13), the gap between the positioning stopper 4 and the ratchet wheels 2 stays the same even if the position of the positioning stopper 4 relative to the belt conveyer 3 is shifted forward (to make the distance from the belt conveyor 3 greater).

FIG. 3 illustrate the operation of the regulation rings 26 and ratchet wheels 2 of the ratchet device 12. Before the front end of the empty bag 1 (the empty bag being indicated by the two-dot chain line) fed on the belt conveyer 3 by the empty bag separating means 11 (see FIG. 1) arrives at the delivery position (in FIG. 3, the position where the ratchet wheels 2 are positioned) of the ratchet wheels 2, the air cylinder (not shown) in the sub-frame 13 operates, so that the pivoting arms 23 are thus swung, thus moving the ratchet wheels 2 to the delivery position on the belt conveyer 3. Accordingly, even if the empty bag 1 is warped upward, the front portion of the empty bag 1 is pressed down by the ratchet wheels 2 that is rotating (see arrow R), so that the empty bag 1 (the empty bag indicated by the solid line) is flattened and fed to the positioning stopper 4.

When the pivoting arms 23 are swung by the air cylinder in the sub-frame 13, and the ratchet wheels 2 are in the delivery position, the ratchet wheels 2 come in contact with and are pushed against the belt conveyer 3 or the upper surface of the empty bag 1 by the pressure of the air cylinder. If at such time the pushing force is weak, only the pawl elements 2*b* of the ratchet wheels 2 come into contact with the belt conveyer 3 or the upper surface of the empty bag 1 (the pawl elements 2*b* will bend depending on the magnitude of the pushing force).

If on the other hand, the pushing force is strong, then, as shown in FIG. 3, the pawl elements 2*b* undergo more bending, and the regulation rings 26 come in contact with the belt conveyer 3 or the upper surface of the empty bag 1. However, the ratchet wheels 2 do not descend further. As a result, the force of contact of the ratchet wheels 2 with the empty bag 1 (the extent of bending of the flexible pawls) does not become excessive, and thus overfeeding of the empty bag can be prevented. Furthermore, the regulation rings 26 in contact with the upper surface of the empty bag 1 freely rotate when the empty bag 1 is being fed forward by the ratchet wheels 2.

The invention claimed is:

1. A conveyer magazine-type empty bag supplying apparatus comprising:

a belt conveyer for feeding a set of empty bags stacked with a displacement in direction parallel to a conveying direction of the conveyer such that mouths of the bags face forward in the conveying direction and upper empty bags are shifted forward in the conveying direction;

an empty bag separating means provided above the belt conveyer for separating a topmost empty bag from the set of empty bags and feeding the separated empty bag forward;

a positioning stopper having a stop surface and provided near a forward end of the belt conveyer so that a front end of the separated empty bag on the belt conveyer comes into touch with the stop surface;

a ratchet wheel provided on a forward side of the empty bag separating means and formed with a plurality of flexible radially-extending pawl elements therearound, the ratchet wheel being connected to a drive source, rotated while being moved between a delivery position and a retracted position, thus in the delivery position coming into contact with the empty bag that is fed by the empty bag separating means, feeding the empty bag forward, and causing the empty bag to come into touch with the positioning stopper; and an empty bag suction member movable up and down between a suction position and a pickup position located higher than the suction position, the empty bag suction member adhering at the suction position to an upper surface of the empty bag positioned by the positioning stopper, wherein the delivery position of the ratchet wheel is between the positioning stopper and the empty bag suction member, and the retracted position of the ratchet wheel is on a front side which is beyond the stop surface of the positioning stopper.

2. The conveyer magazine-type empty bag supplying apparatus according to claim 1, wherein a timing of ratchet wheel movement to the delivery position is set to occur prior to a moment when the front end of the empty bag fed by the empty bag separating means reaches the delivery position of the ratchet wheel.

3. The conveyer magazine-type empty bag supplying apparatus according to claim 1, wherein a regulation ring having a circumferential surface with a diameter smaller than a diameter of a rotational trajectory of the distal end of the pawl element is rotatably installed on a rotary shaft for the ratchet wheel.

4. The conveyer magazine-type empty bag supplying apparatus according to claim 2, wherein a regulation ring having a circumferential surface with a diameter smaller than a diameter of a rotational trajectory of the distal end of the pawl element is rotatably installed on a rotary shaft for the ratchet wheel.

5. The conveyer magazine-type empty bag supplying apparatus according to any one of claims 1-4, wherein a sub-frame is provided at the forward end of the belt conveyer so as to be positionally adjustable to come closer to and separated from each other, and the positioning stopper and ratchet wheel is provided in the sub-frame.

* * * * *